United States Patent [19]

Tranchero

[11] Patent Number: 4,667,771

[45] Date of Patent: May 26, 1987

[54] VEHICLE TRANSPORTED SELECTIVELY ELEVATABLE NACELLE SUPPORTING LIFTING CRANE

[76] Inventor: Jacques Tranchero, Via Villanovetta, 2, 12026 Piasco, Cuneo, Italy

[21] Appl. No.: 488,211

[22] Filed: Apr. 25, 1983

[51] Int. Cl.[4] ..... B66F 11/04

[52] U.S. Cl. ..... 182/2

[58] Field of Search ..... 182/63, 2

[56] References Cited

U.S. PATENT DOCUMENTS

| | | | |
|---|---|---|---|
| 3,378,103 | 4/1968 | Zweight | 182/2 |
| 3,470,980 | 10/1969 | Irwin | 182/2 |
| 3,516,512 | 6/1970 | Kupke | 182/63 |
| 3,605,941 | 1/1972 | Edwards | 182/2 |
| 3,708,037 | 1/1973 | Tranchero | 182/2 |
| 4,053,075 | 10/1977 | Stedman | 182/2 |

FOREIGN PATENT DOCUMENTS

| | | |
|---|---|---|
| 916408 | 4/1972 | Italy . |
| 1044964 | 4/1980 | Italy . |

*Primary Examiner*—Reinaldo P. Machado

[57] ABSTRACT

A nacelle supporting lifting crane comprising four articulated lever stages, including a first lever stage articulated to a bracket integral with a thrust block rotatable in opposed directions around its vertical axis with respect to a fixed base supported by four jacks. Said base may be mounted on the platform of a truck for transport of the crane. The end of an uppermost lever stage is articulated to a bracket supporting a nacelle for lifting things and/or persons.

7 Claims, 40 Drawing Figures

FIG. 12
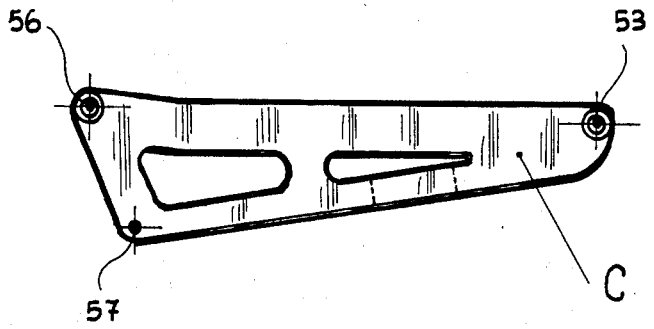
FIG. 13
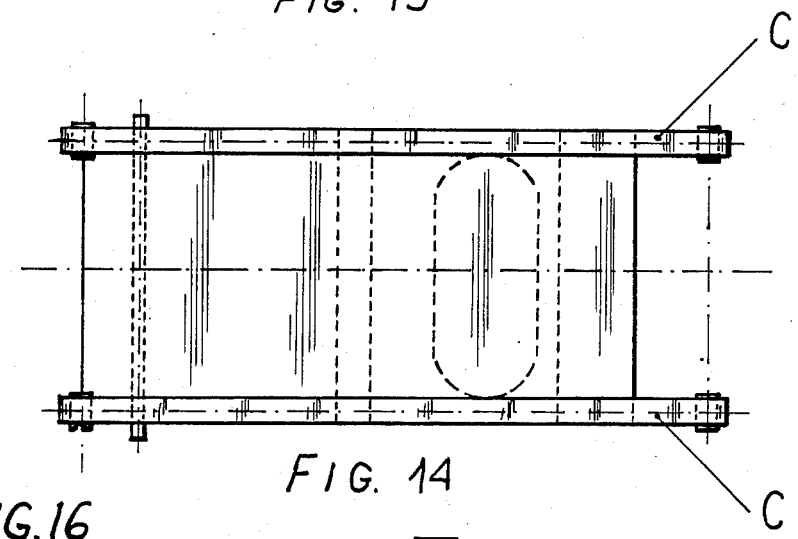
FIG. 14
FIG. 16
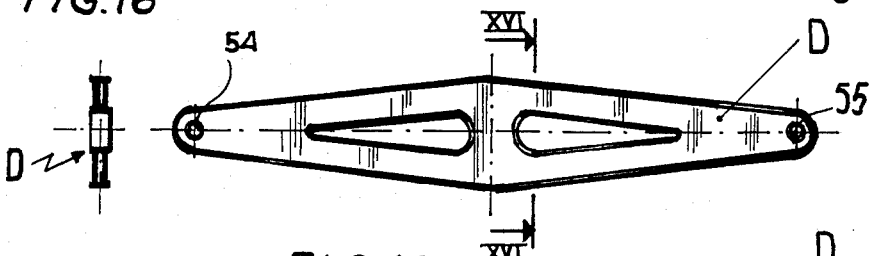
FIG. 15
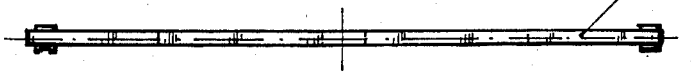

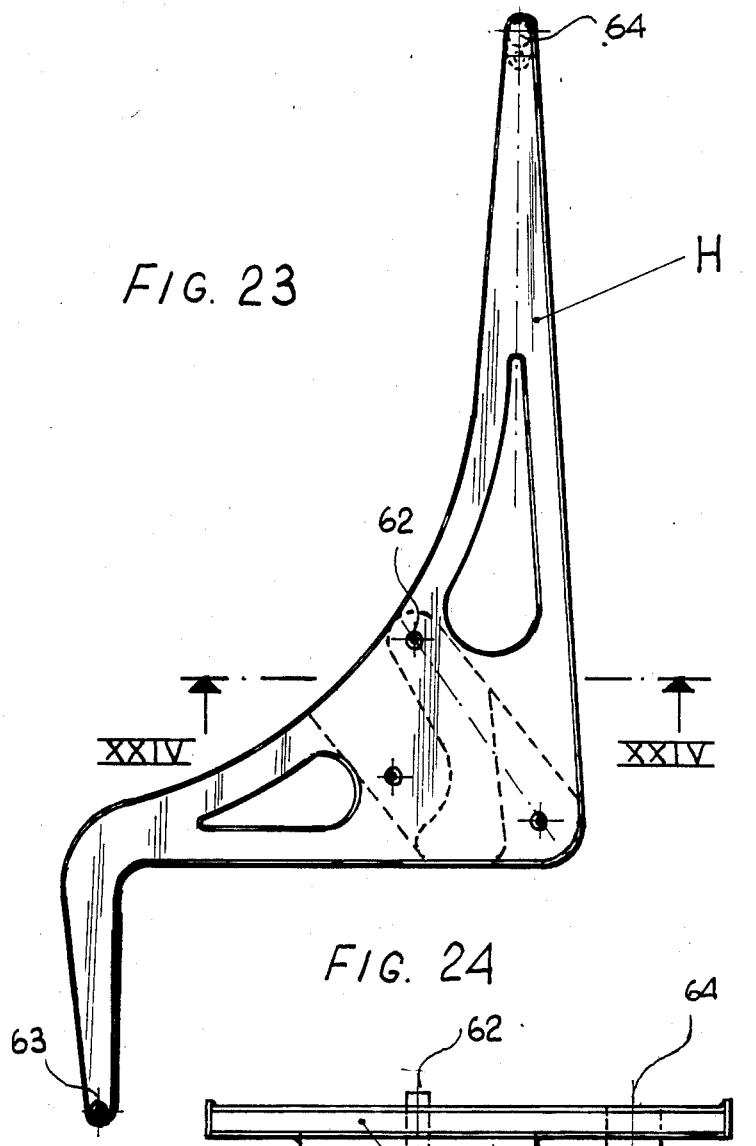
FIG. 23
FIG. 24
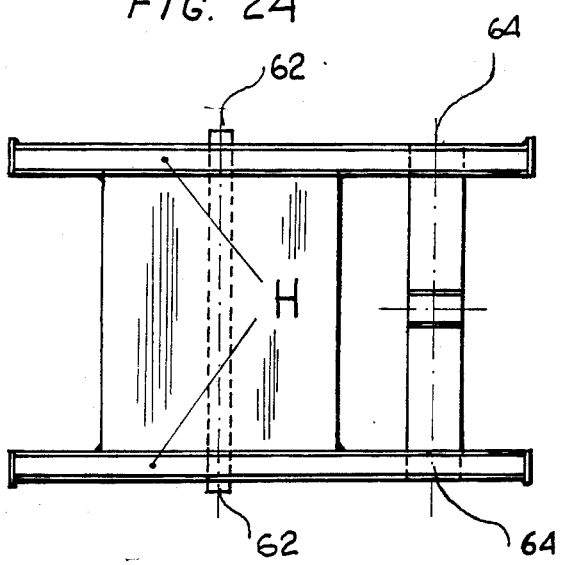

VEHICLE TRANSPORTED SELECTIVELY ELEVATABLE NACELLE SUPPORTING LIFTING CRANE

BACKGROUND OF THE INVENTION

As shown by Italian Pat. Nos. 916408 and 1.044.964, the former corresponding to U.S. Pat. No. 3,708,037, in the name of applicant, cranes or lifting machines are known provided with a terminal nacelle suitable for supporting people and things at different heights. The cranes of the aforesaid patents comprise a plurality of lifting stages formed by pairs of metallic levers, articulatedly connected and subject to movement by hydraulic cylinders. These known cranes are fairly complex, and are relatively limited in the height which may be reached by the nacelle, as well as of the weight which may be transported by same.

An object of the invention is to provide a lifting crane for a nacelle of a carrying capacity of 1000 kg. to selective heights between a few meters and over 35 meters.

Another object of the invention is to provide a crane of the aforesaid type which permits rotation of the nacelle at any point of elevation.

A further object of the invention is to provide a self-contained motor transportable lifting crane which may be rapidly loaded on the platform of any truck having suitable dimensions and which is not supported by the truck when the lifting crane is in its operative phase.

BRIEF DESCRIPTION OF THE INVENTION

In attaining the above objects, a crane is provided carrying at its free end a nacelle capable of supporting a useful load of more than 1000 kg. at heights varying from about three meters to 35 meters. The crane, according to the invention, is characterized in that it comprises a base, formed by a central box-structured body provided with four radial projections or arms, each containing a horizontally extensible hydraulic cylinder ending with a vertically extensible hydraulic jack.

Said base carries a "U" shaped bracket with vertical arms, integral with a thrust bloc, which is mounted for pivoting about the central vertical axis of the base, and activable by a suitable motor, preferably hydraulic. The vertical arms of said bracket are pivoted to one end of a first lower lever stage whoe other end is pivoted to one end of a second lever stage, comprising a lever and tie rod, whole other ends are articulated to a first intermediate member, referred to as a "primary cradle"; and a third lever stage also comprising a lever and tie rod, having one end articulated to said "primary cradle" with its opposed ends articulated to a second intermediate member, referred to as a "counter cradle," which is articulated to one end of a fourth lifting stage comprising a lever and a tie rod, which is articulated to a third intermediate member with respect to which a lever is articulated which is also articulated to a supporting bracket for the nacelle containing the load to be lifted.

All connections between articulated lever stages are formed by horizontal pins.

The lifting and lowering movement of the first and second stages is attained by the use of a pair of hydraulic piston-cylinder assemblies, while movement between the second and the third stages, as well as between the third and the fourth, is attained by the use of single hydraulic piston-cylinder assemblies.

A feature of the crane according to the invention resides in the structure of box-shaped sheet steel and the shape of all the essential members which form it so as to give the machine: the maximum load capacity while retaining safety limits; a relatively high weight supporting capacity for each pound of machine weight; total damping of vibrations even with the nacelle at its maximum height; easy and rapid transportability due to the base formation of substantially "x" shape with jacks at the ends of its four arms to support the machine in its operative phase and to lift the base above the height of the truck or other motor vehicle bed on which it is transported.

A further feature of the lifting crane, according to the invention, derives from the shape of the various members forming the crane, allowing some of them, when the machine is completely lowered, to be received within cavities of other members, so as to reduce to a minimum the height of the collapsed crane and vehicle which carries it to allow passage through tunnels or underpasses.

BRIEF DESCRIPTION OF THE DRAWINGS

The specific details of a preferred embodiment of the invention and of the manner and process of making and using it and of the best mode contemplated for practicing the invention, will be described in clear, concise and exact terms in conjunction with the following drawings, wherein:

FIG. 12 is a side view of a lever forming part of the first lifting stage;

FIG. 13 is a plan view of same;

FIG. 14 is a side view of a lever which associated with the lever of FIG. 13 forms the first lifting stage;

FIGS. 15 and 16 show a front and end view of the lever of FIG. 14;

FIG. 23 is a side view of the intermediate member or "cradle" which connects the second to the third lifting stage;

FIG. 24 is a view on section line XXIV—XXIV of FIG. 23;

DESCRIPTION OF PREFERRED EMBODIMENT OF THE INVENTION

Figure 4:
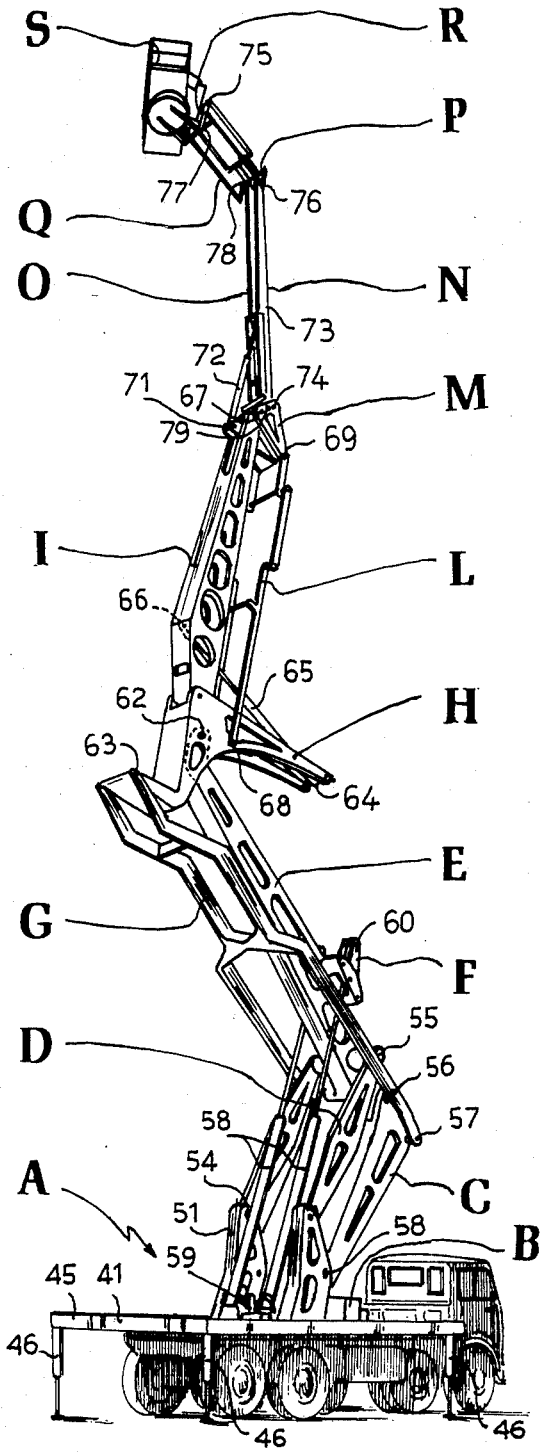
FIG. 4 is a perspective view of the crane in elevated position on a truck.
Figure 5:
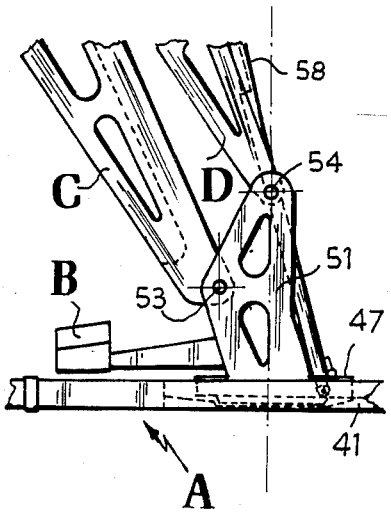
FIG. 5 is a detail of the base.

With reference to the drawings, FIG. 4 illustratively shows the lifting crane in maximum elevation position.

The essential members of the machine are marked by alphabetic letters which are employed to identify the same elements in the subsequent detail figures.

Figure 6:
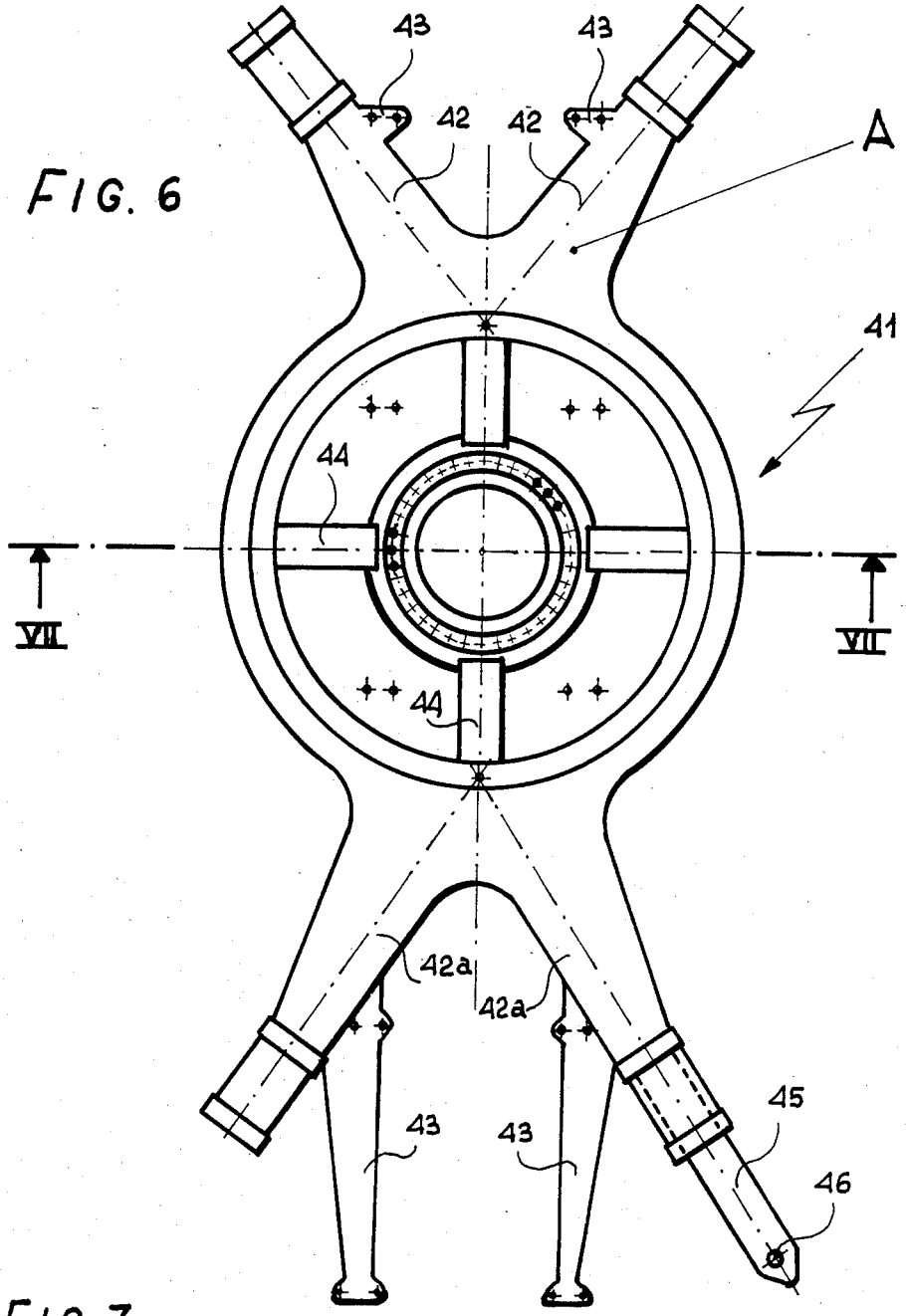
FIG. 6 is a top plan view of the box-shaped base.

The base of the machine is formed by the box-shaped body 41, provided with four arms, 42, 42*a* as best seen in FIG. 6.

Figure 1:
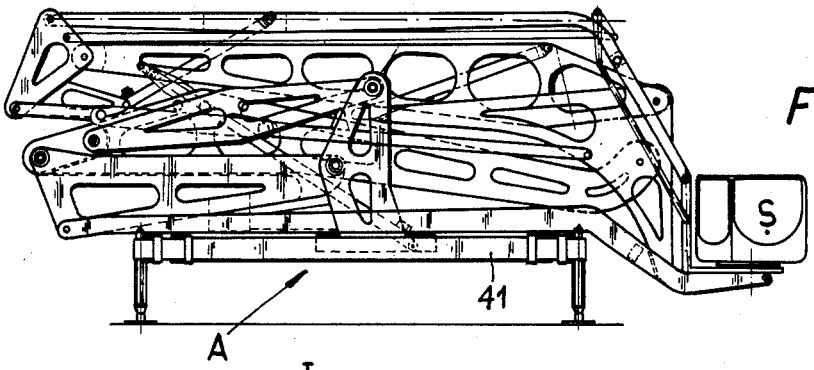
FIG. 1 is a side view of the crane shown completely lowered.
Figure 2:
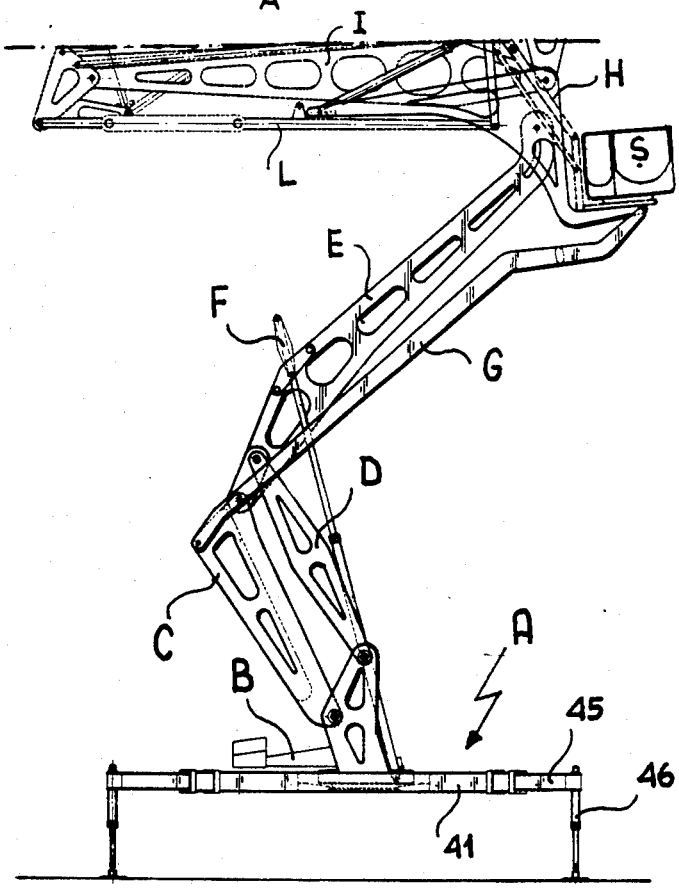
FIG. 2 is a side view of the machine, with the first and the second lifting stages partially raised.
Figure 3:
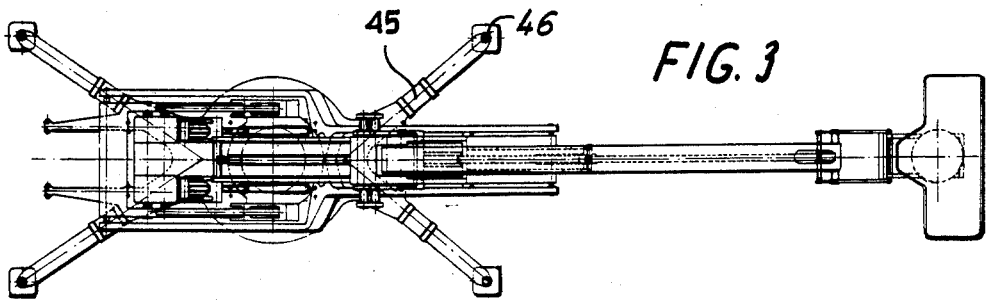
FIG. 3 is a top plan view of the crane with the top lifting stages extended.
Figure 7:
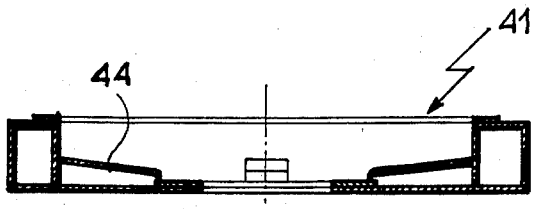
FIG. 7 is a cross-sectional view of the base on line VII—VII of FIG. 6.

Projections 43 provide anchors for the base 41 with respect to a supporting plane. Ribs 44 reinforce the base, as seen in FIGS. 6 and 7. On the end of each of arms 42, 42*a*, there is mounted a telescopically extensible stablizer element 45, as seen in FIG. 3, and only one of which is shown in FIG. 6.

Each element 45 is connected to a double acting horizontally extending hydraulic piston, which carries a vertically extending hydraulic leg 46, as best seen in FIG. 4. The box-shaped body 41 acts as a reservoir for oil, under the pressure of a pump which is not represented, and through sequential valve groups, actuates the stablizer elements 45 and the legs 46.

Figure 9:
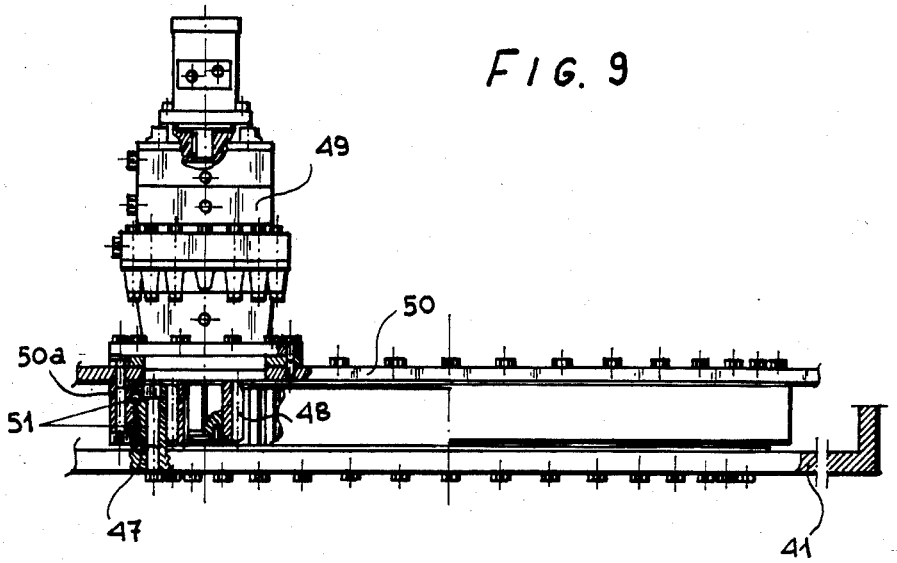
FIG. 9 is a side view partially in cross-section of the rotating mechanism.
Figure 8:
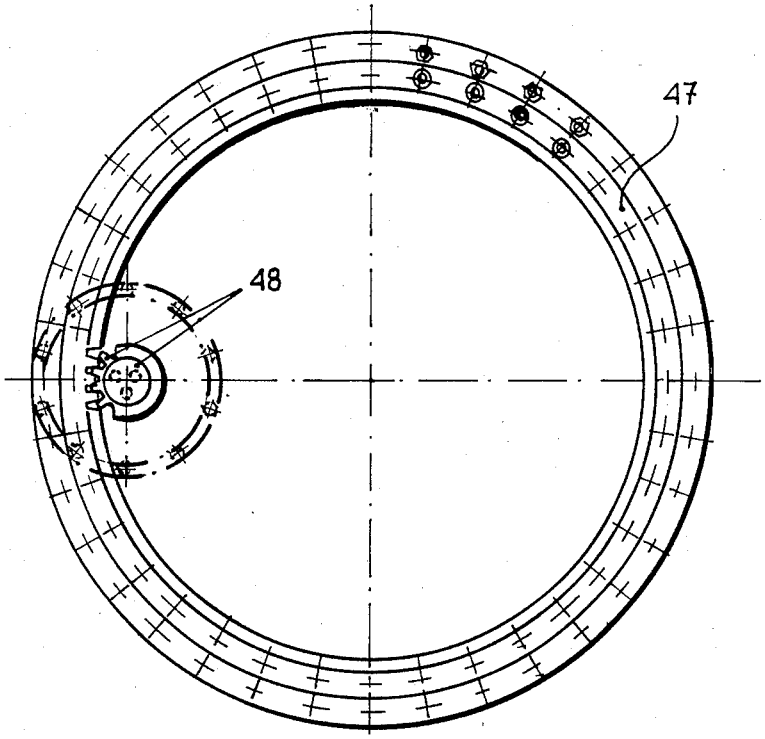
FIG. 8 is a schematic top view of the rotating part with respect to the fixed part of the base.

Within the body 41, as best seen in FIGS. 8 and 9 is a toothed crown 47, having inner teeth meshing with pinion 48 on shaft of hydraulic motor 49.

In turn, the hydraulic motor 49 is secured to cap 50, which is formed with an annular cyldrical edge 50*a* as best seen in FIG. 9, which is rotatable on bearings 51., with respect to toothed crown 47.

Figure 10:
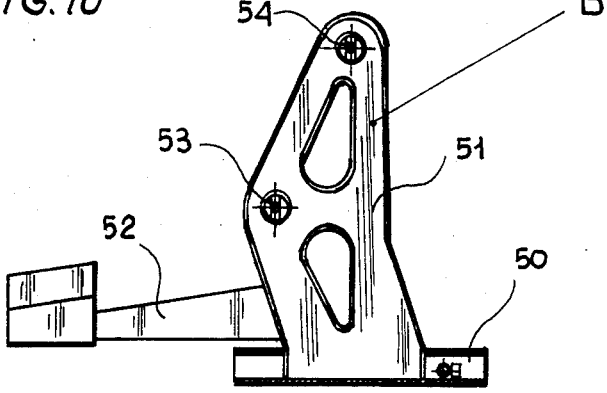
FIG. 10 is a side view of the rotating bracket.
Figure 11:
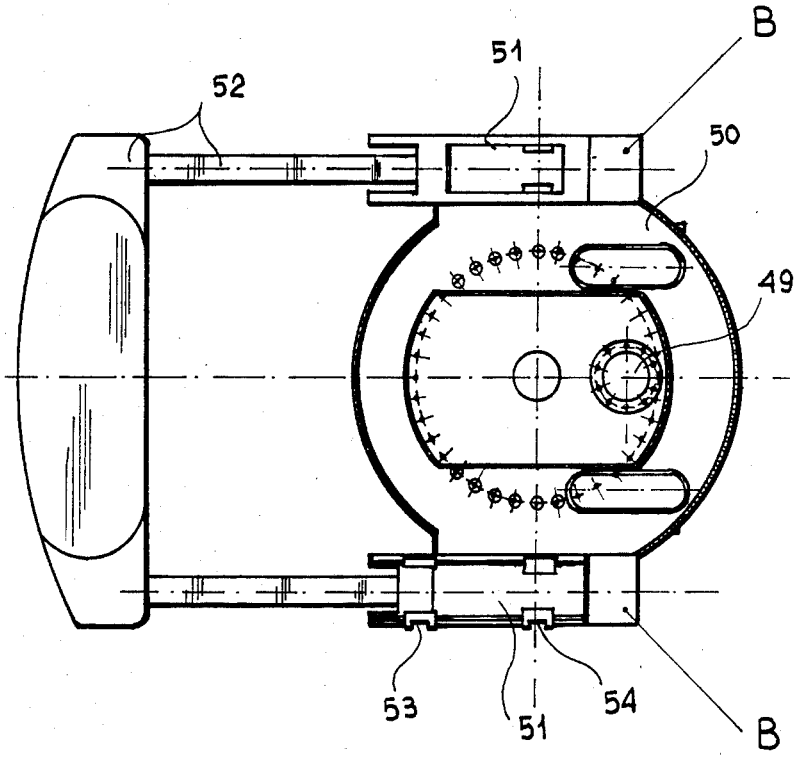
FIG. 11 is a top plan view of the bracket of FIG. 19.

Cap 50, as best seen in FIGS. 10 and 11, carries link B formed by a pair of symmetrical uprights 51 and the counterweight 52. Thus, by activating motor 49 and its pinion 48 in one or the other direction, cap 50 with uprights 51 rotates with respect to the machine base 41.

Figure 21:
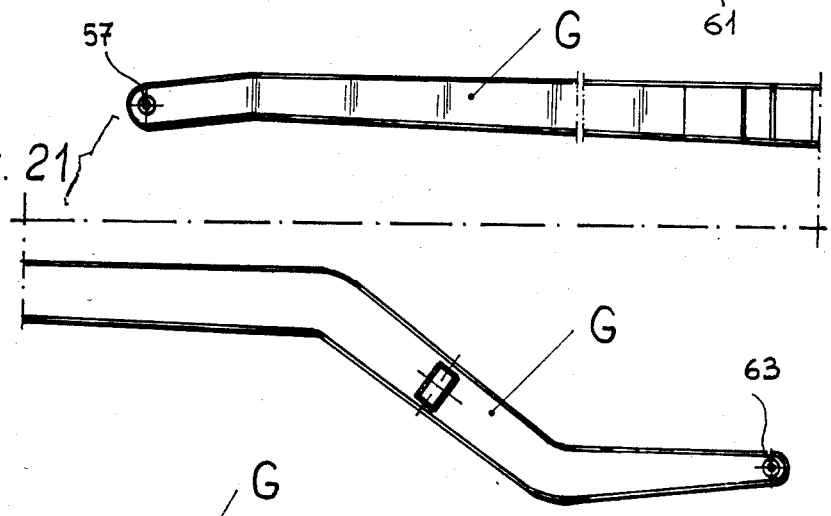
FIG. 21 is a broken and bracketed side view of a tie rod associated with the lever elements of FIG. 17 and FIG. 18.
Figure 22:
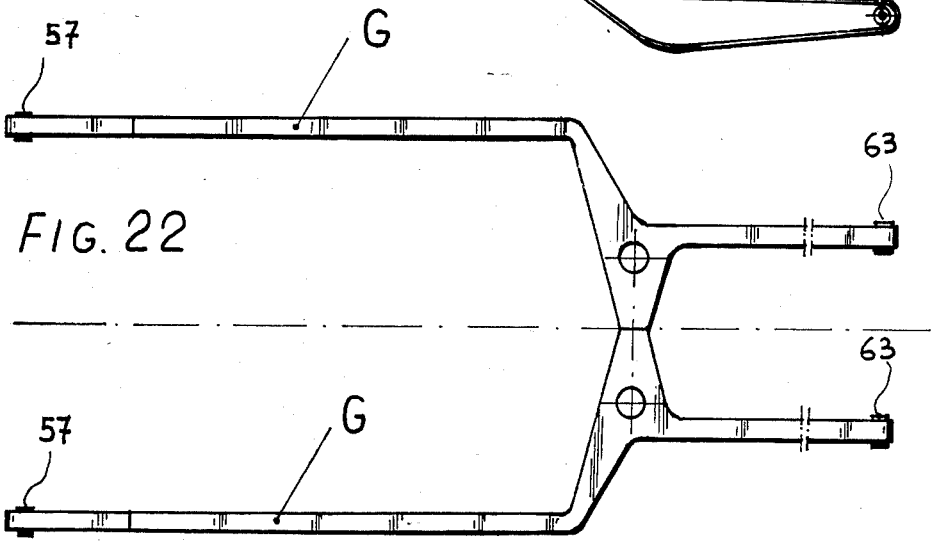
FIG. 22 is a partial plan view on a different scale of the tie rod of FIG. 21.
Figure 25:
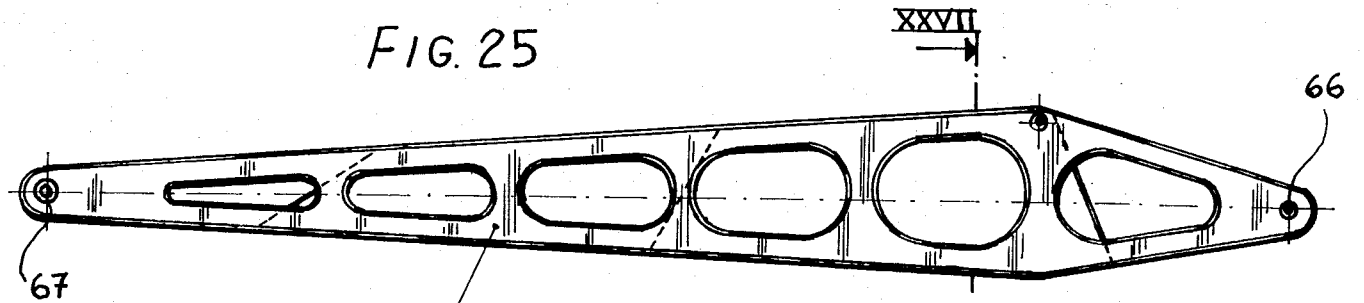
FIG. 25 is the side view of a lever of the third lifting stage.
Figure 26:
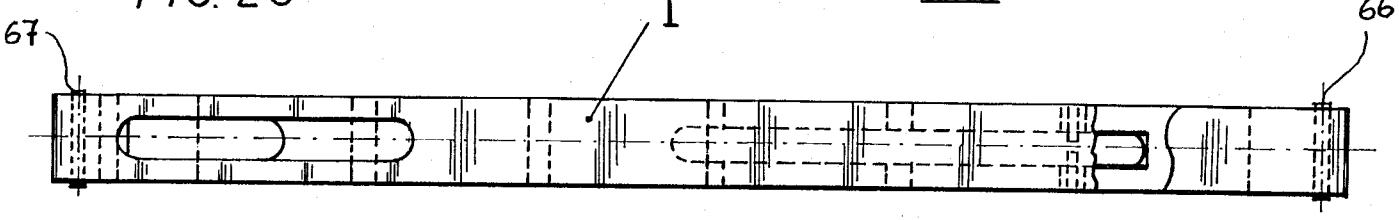
FIG. 26 is the front elevational view of same.
Figure 27:
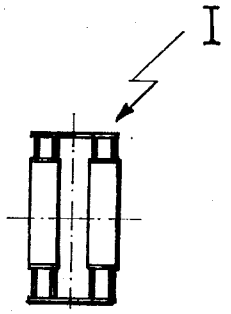
FIG. 27 is a view along lines XXVII—XXVII of FIG. 25.

Lever C as best seen in FIGS. 4, 10, 12 and 13 is articulated on of link uprights 51 B at 53 (see FIG. 10) while one end of lever D, as seen in FIGS. 14, 15 and 16 is pivoted at 54 to link B and at its opposed end is articulated at 55 near one of the ends of lever E, as seen in FIGS. 2, 4, 17 and 18. Lever E is pivoted at 56 to lever C which is pivoted at 57 to the tie rod G, as seen in FIGS. 21 and 22.

Figure 17:
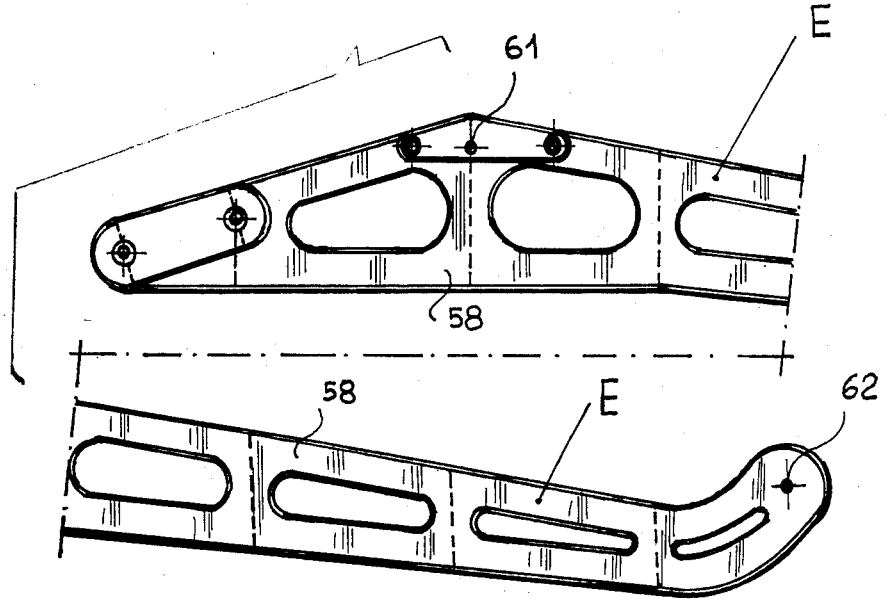
FIG. 17 shows broken and bracketed a side view of a lever of the second lifting stage.
Figure 19:
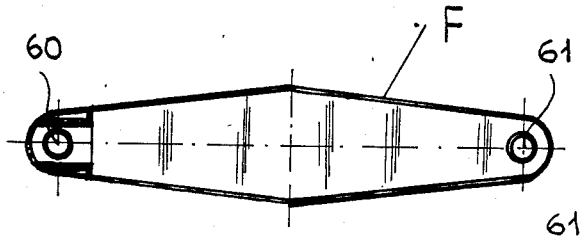
FIG. 19 is a side view of a detail pertaining to the second lifting stage.
Figure 20:
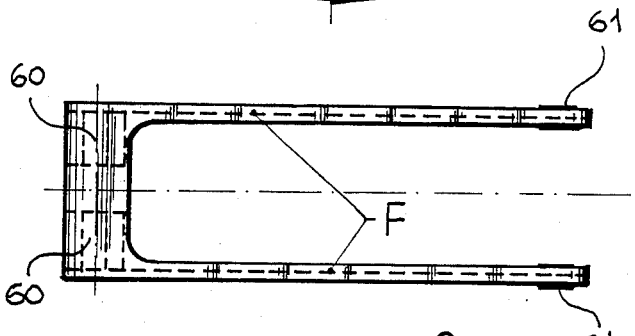
FIG. 20 is the plan view of same detail.

A pair of hydraulic cylinders 58 (FIG. 4) is pivoted at 59 to the base A and the free end of the piston rods are pivoted at 60 to connecting rod F (see FIGS. 19 and 20), which is pivoted at 61 to the elbow of lever E (see FIG. 17).

Figure 18:
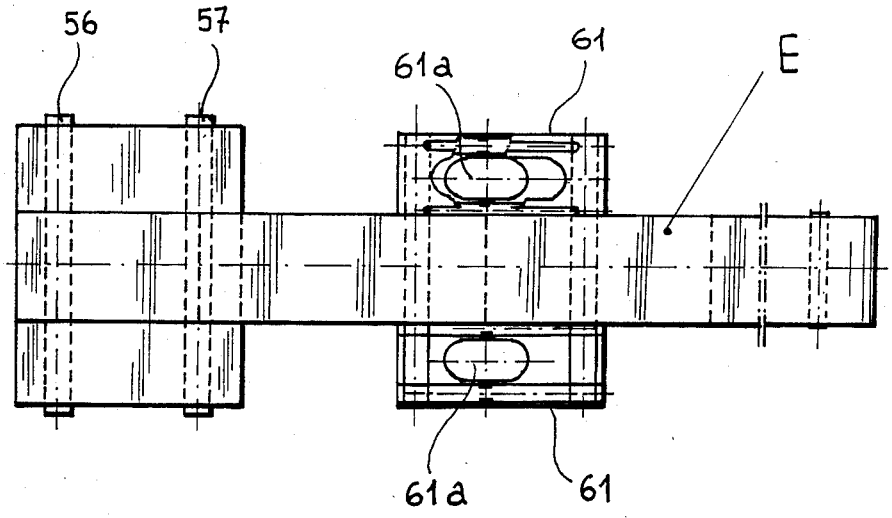
FIG. 18 on a different scale, is the plan view of the same lever in operative position.

The piston rods of cylinders 58 pass through windows 61a formed in the lever E (FIG. 18). Lever E is pivoted at 62 to cradle H (FIGS. 23 and 24), which is pivoted at 63 to tie rod G (see FIG. 4). Cradle H, as best seen in FIG. 4, is pivoted to hydraulic cylinder 65, which has the end of its piston stem pivoted to lever I at 66 (see FIGS. 4, 25, 26 and 27).

Figure 31:
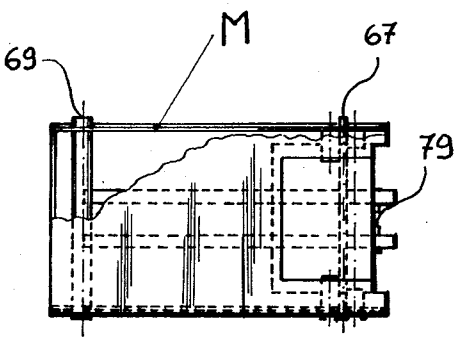
FIG. 31 is a plan top view of the counter cradle.
Figure 30:
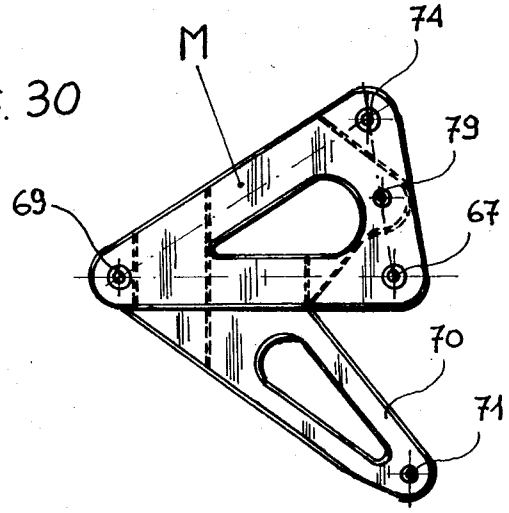
FIG. 30 represents a side view of the second intermediate member, or so-called "counter cradle"

Lever I, is pivoted to counter cradle, as best seen in FIGS. 4, 30 and 31.

Figure 28:
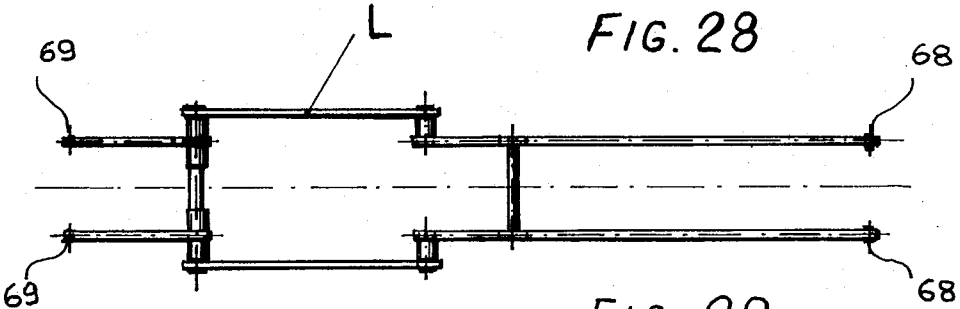
FIG. 28 is the plan view of the tie rod associated with the lever of FIGS. 25, 26 and 27.
Figure 29:
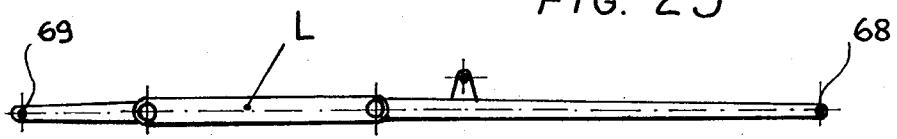
FIG. 29 is a side view of the tie rod of FIG. 28.
Figure 32:
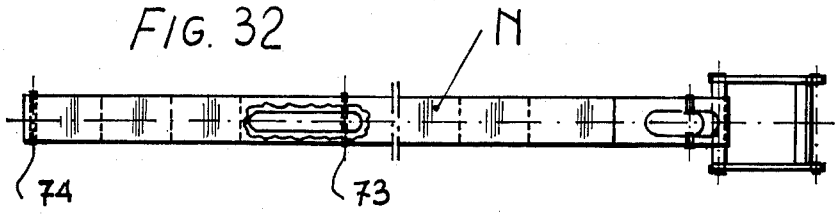
FIG. 32 is a plan view of the lever forming the third lifting state.
Figure 33:
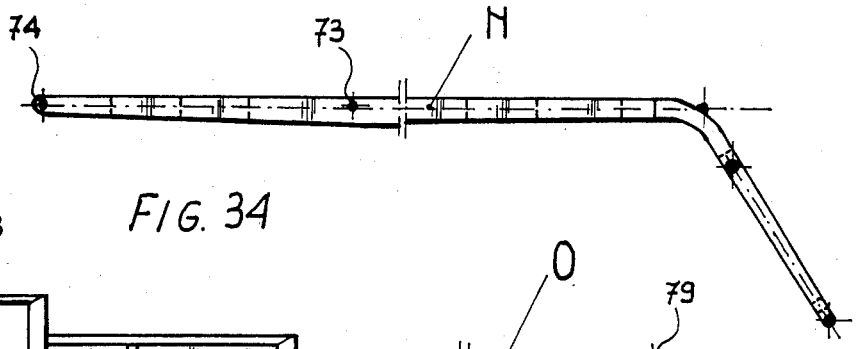
FIG. 33 illustrates a side view of the same lever.
Figure 34:
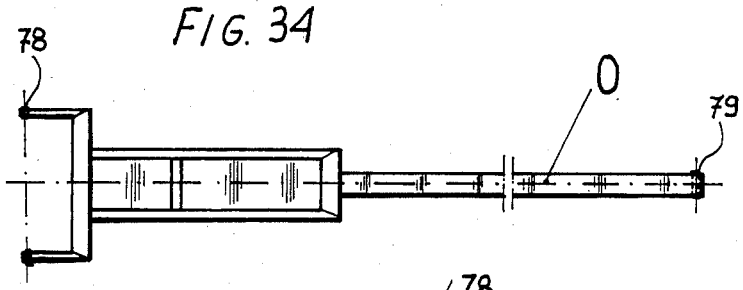
FIG. 34 is the plan view of the tie rod cooperating with the lever represented on FIGS. 32 and 33.

Cradle H is pivoted at 68 to one end of tie rod L (see FIGS. 4, 28 and 29), which at its opposed end is pivoted at 69 to counter cradle M. Counter cradle M is provided with projection 70, as best seen in FIG. 30, which is pivoted at 71 to the base of the hydraulic cylinder 72, as best seen in FIG. 4, which has the free end of its piston stem pivoted at 73 to the lever N (FIGS. 32 and 33). Lever N articulated at 74 to the counter cradle M and the curved end articulated at 75 to the bracket R supporting the nacelle S (FIG. 4).

Figure 37:
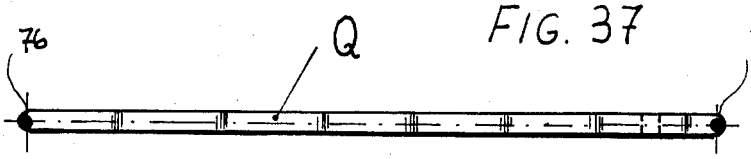
FIG. 37 is a side view of a tie rod cooperating with the lever of the third lifting stage.
Figure 38:
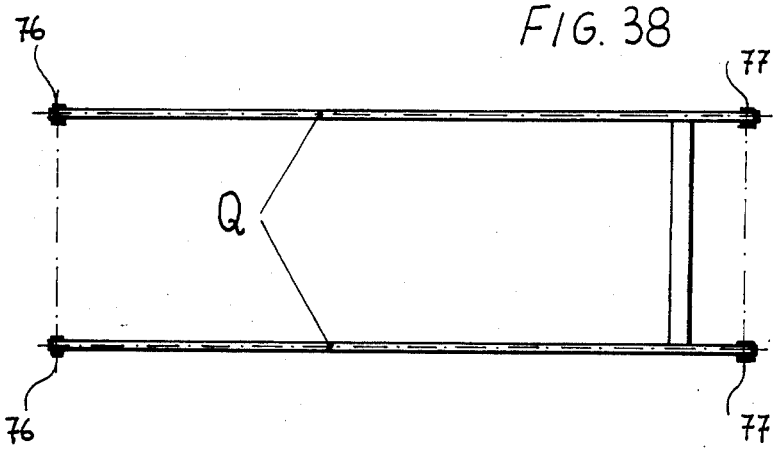
FIG. 38 is a top plan view of the same.
Figure 39:
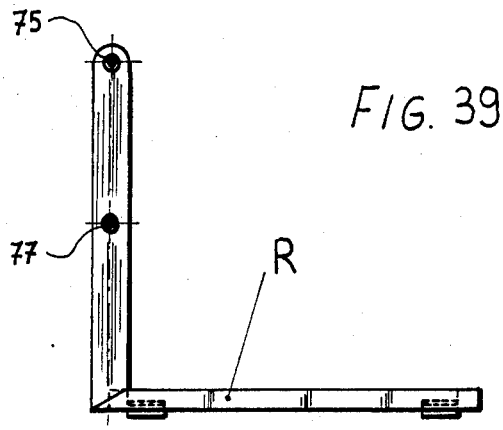
FIG. 39 represents the supporting bracket for the nacelle in side view.
Figure 40:
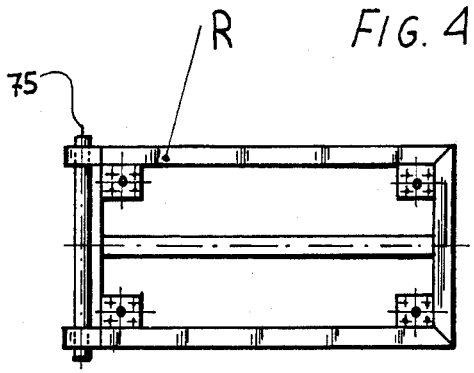
FIG. 40 is a top plan view of the supporting bracket.

As best seen in FIG. 4, the top of lever N at 76 is pivoted to one end of the tie rod Q (FIGS. 37 and 38) which at its opposed end at 77 is pivoted to bracket R.

Figure 35:
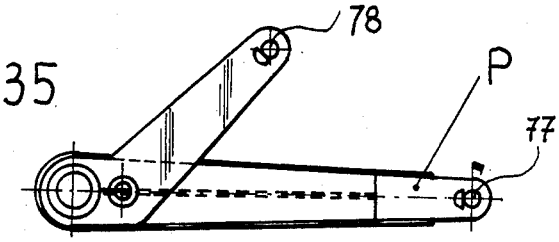
FIG. 35 is the side view of the third connecting member.
Figure 36:
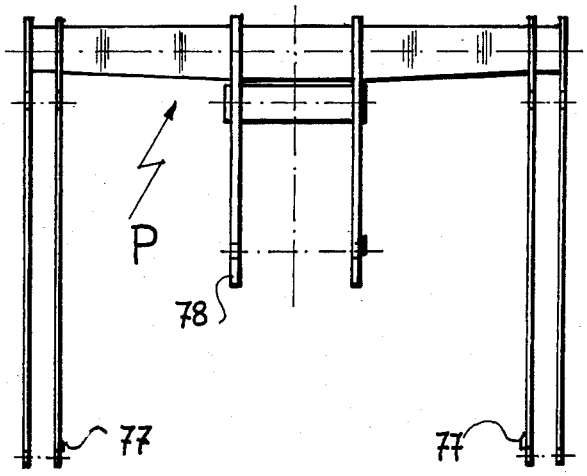
FIG. 36 is a plan view of same.

Crank P, as best seen in FIGS. 35 and 36 is pivoted, as seen in FIG. 4, to one end of a tie rod Q (see FIG. 4) which has its opposed end pivoted at 79 to counter cradle M.

The bracket R and the nacelle S are thus stabilized as moved. The nacelle S is mounted for rotation about its vertical axis, with respect to the support R by means of a thrust block and a pinion which may be actuated by a motor controlled from the main board of the nacelle.

The machine which has been described is provided with a hydraulic system comprising valves which may be controlled from a control board.

What is claimed is:

1. A machine transportable on a motor vehicle and suitable for lifting a nacelle loaded with things and/or, persons to different heights characterized in that its structure comprises: a box-shaped base provided with radial horizontal arms terminating in jacks having a vertical axis and suitable to support the machine, further characterized in that with respect to said base a crown having an upper cap is centrally mounted for rotation around a vertical axis in two directions by means of a tooth pinion and provided with a pair of vertical brackets with respect to which a first pair of levers are pivotally mounted and form the lowermost of four pivotally connected lifting stages for a nacelle carried at the upper end of the fourth lifing state with the ends of the fist pair of levers (C,D) articulated with respect to one pair of brackets integral with the upper cap of said rotating crown and the opposed ends of said levers articulated to the ends of a lever and a tie rod whose opposed ends are articulated on an intermediate cradle member, which is pivoted to the ends of a lever and a tie rod which form the third lifting stage whose opposed ends are pivoted to a counter cradle with respect to which the ends of a lever and a tie rod are pivoted and said lever and tie rod, together with a connecting rod and a tie rod form the fourth lifting stage for the support of a nacelle to bring said nacelle to different heights.

2. A machine comprising four lifting stages formed by pivotally connected levers which may be actuated by means of hydraulic cylinders according to claim 1, characterized in that its base in a plan view has a substantially "X" shaped profile forming said radial arms which are each provided with a double acting hydraulic cylinder with a horizontal axis terminating at a hydraulic jack with a vertical axis.

3. A machine transportable on a motor vehicle and suitable for lifting a nacelle loaded with things and/or persons to different heights characterized in that its structure comprises: a box-shaped base provided with radial horizontal arms terminating in jacks having a vertical axis and suitable to support the machine, further characterized in that with respect to said base a crown having an upper cap is centrally mounted for rotation around a vertical axis in two directions by means of a tooth pinion and provided with a pair of vertical brackets with respect to which a first pair of levers are pivotally mounted and form the lowermost of four pivotally connecting lifting stages for a nacelle carried at the upper end of the fourth lifting stage further characterized in that said first pair of levers comprises a box-shaped lever and a pair of arms; and having a second stage comprising a box-shaped lever and a tie rod formed by a frame, which viewed in plan, comprises two rectangular sections having different length and width; and having between the second and third lifting stages a cradle member formed by a box-shaped body with a lateral profile presenting two juxtaposed branches one of which is pivoted to a tie rod and the other to a hydraulic cylinder controlling the third lifting stage.

4. A machine transportable on a motor vehicle and suitable for lifting a nacelle loaded with things and/or persons to different heights characterized in that its structure comprises: a box-shaped base provided with radial horizontal arms terminating in jacks having a vertical axis and suitable to support the machine, further characterized in that with respect to said base a crown having an upper cap is centrally mounted for rotation around a vertical axis in two directions by means of a tooth pinion and provided with a pair of vertical brackets with respect to which a first pair of levers are pivotally mounted and form the lowermost of four pivotally connected lifting stages for a nacelle carried at the upper end of the fourth lifting stage further characterized in that a third lifting stage comprises: a box-shaped lever pivoted at one end to cradle and at the other end to a so-called counter cradle; and a tie rod formed by a frame comprising three rectangular sections of different dimensions, the central of which has the greatest width, said frame having ends pivoted with respect to cradle and counter cradle.

5. A machine according to claim 1, characterized in that the counter cradle is of a triangular shape and is pivoted to a hydraulic cylinder which at the end of its piston stem, is pivoted to a lever which together with a first tie rod and a second tie rod forms the fourth lifting stage for the nacelle supported by a bracket having a square profile.

6. A machine according to claim 1, characterized in that the first lifting stage is actuated by a pair of hydraulic cylinders pivoted with respect to the base and having the end of the respective piston stems of each hydraulic cylinder pivoted to connecting rods pivoted to the sides of lever (E).

7. A machine according to claim 1, comprising: an upper fourth stage having an arm; a connecting rod one end of which coupled to said arm; a tie rod coupled to said arm; and a second tie rod pivoted to said tie rod to stabilize the position of the support and the nacelle.

* * * * *